US011268508B2

(12) United States Patent
Miyazawa

(10) Patent No.: US 11,268,508 B2
(45) Date of Patent: Mar. 8, 2022

(54) VARIABLE DISPLACEMENT PUMP

(71) Applicant: HITACHI AUTOMOTIVE SYSTEMS, LTD., Hitachinaka (JP)

(72) Inventor: Shigeyuki Miyazawa, Saitama (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 155 days.

(21) Appl. No.: 16/462,473

(22) PCT Filed: Oct. 27, 2017

(86) PCT No.: PCT/JP2017/038845
§ 371 (c)(1),
(2) Date: May 20, 2019

(87) PCT Pub. No.: WO2018/100938
PCT Pub. Date: Jun. 7, 2018

(65) Prior Publication Data

US 2019/0376509 A1 Dec. 12, 2019

(30) Foreign Application Priority Data

Nov. 30, 2016 (JP) ..... JP2016-232315

(51) Int. Cl.
*F04C 2/344* (2006.01)
*F04C 14/22* (2006.01)
(Continued)

(52) U.S. Cl.
CPC ..... *F04C 2/344* (2013.01); *F04C 14/12* (2013.01); *F04C 14/226* (2013.01); *F04C 14/24* (2013.01); *F04C 28/12* (2013.01)

(58) Field of Classification Search
CPC ..... F04C 2/344; F04C 14/12; F04C 14/223; F04C 14/226; F04C 28/10; F04C 14/10;
(Continued)

(56) References Cited

U.S. PATENT DOCUMENTS 9,494,153 B2 * 11/2016 Watanabe ..... F04C 14/226
2001/0031204 A1 * 10/2001 Oba ..... F04C 14/226 417/220

(Continued)

FOREIGN PATENT DOCUMENTS

JP 2000-136781 A 5/2000

OTHER PUBLICATIONS

International Search Report dated Jan. 16, 2018 in International Application No. PCT/JP2017/038845.

(Continued)

*Primary Examiner* — Devon C Kramer
*Assistant Examiner* — David N Brandt
(74) *Attorney, Agent, or Firm* — Foley & Lardner LLP

(57) ABSTRACT

A variable displacement pump according to the present invention is notably configured such that the opening area of a variable metering orifice (MO) is variably controlled by a second control valve (6) as a spool valve having a second spool valve body (61). According to this type of the second control valve (6), a larger amount of movement (stroke movement) of the second spool valve body (61) can be ensured. Consequently, the opening area of the variable metering orifice (MO) can be controlled without being restricted by a range of variation in a proper discharge amount based on an amount of movement of a cam ring (2), thereby achieving sufficient energy conservation of the pump.

14 Claims, 10 Drawing Sheets

(51) Int. Cl.
*F04C 14/12* (2006.01)
*F04C 14/24* (2006.01)
*F04C 28/12* (2006.01)

(58) Field of Classification Search
CPC .... F04C 2270/585; F04C 28/12; F04C 14/24; F04C 2/3442
See application file for complete search history.

(56) References Cited

U.S. PATENT DOCUMENTS

2011/0142703 A1* 6/2011 Soeda ..... F04C 2/3442 418/29
2012/0199411 A1* 8/2012 Nonaka ..... B62D 5/063 180/422

OTHER PUBLICATIONS

Written Opinion of the International Searching Authority dated Jan. 16, 2018 in International Application No. PCT/JP2017/038845.

* cited by examiner

VARIABLE DISPLACEMENT PUMP

TECHNICAL FIELD

The present invention relates to a variable displacement pump.

BACKGROUND TECHNOLOGY

As a conventional variable displacement pump, for example, one described in the following patent document 1 has been known.

That is, in this variable displacement pump, a variable metering orifice is provided on the way of a discharge passage such that the opening area of the variable metering orifice is variable in accordance with the moving amount of a cam ring.

PRIOR ART REFERENCE

Patent Document

Patent Document 1: Japanese Patent Application Publication 2000-136781

SUMMARY OF THE INVENTION

Problem to be Solved by the Invention

However, like the conventional variable displacement pump, in a configuration in which the opening area of the variable metering orifice varies in accordance with the moving amount of the cam ring, since the moving amount of the cam ring is minute, a range of variation in the opening area cannot be largely ensured. Consequently, sufficient energy conservation cannot be achieved.

The present invention has been made in consideration of such a technical problem in the conventional variable displacement pump, and an object of the present invention is to provide a variable displacement pump capable of contributing sufficient energy conservation.

Means for Solving the Problem

In particular, the present invention includes a first control valve configured to control the pressure to be introduced into a first fluid pressure chamber by being controlled based on the pressure on the upstream side and the pressure on the downstream side of a variable metering orifice, and a second control valve configured to variably control the opening area of the variable metering orifice. The second control valve includes a valve body controlled based on the pressure of a second fluid pressure chamber or a suction passage and the pressure of the first fluid pressure chamber.

Effect of the Invention

According to the present invention, it is possible to contribute sufficient energy conservation of the pump.

BRIEF DESCRIPTION OF THE DRAWINGS

FIG. 7(*a*) is a drawing showing a state in which engine speed is low, and FIG. 7(*b*) is a drawing showing a state in which engine speed is high.

MODE FOR IMPLEMENTING THE INVENTION

In the following, an embodiment of a variable displacement pump according to the present invention will be explained in detail with reference to the drawings. In addition, in the embodiment shown below, in the same way as conventional one, one is shown in which the variable displacement pump is applied to a fluid pressure source of a power steering device of a vehicle. Moreover, in the following explanation, the direction parallel to a rotation axis Z of a drive shaft 3 is referred to as "axial direction", the direction orthogonal to the rotation axis Z of the drive shaft 3 is referred to as "radial direction", and the direction around the rotation axis Z of the drive shaft 3 is referred to as "circumferential direction".

First Embodiment

Configuration of Variable Displacement Pump

Figure 1:
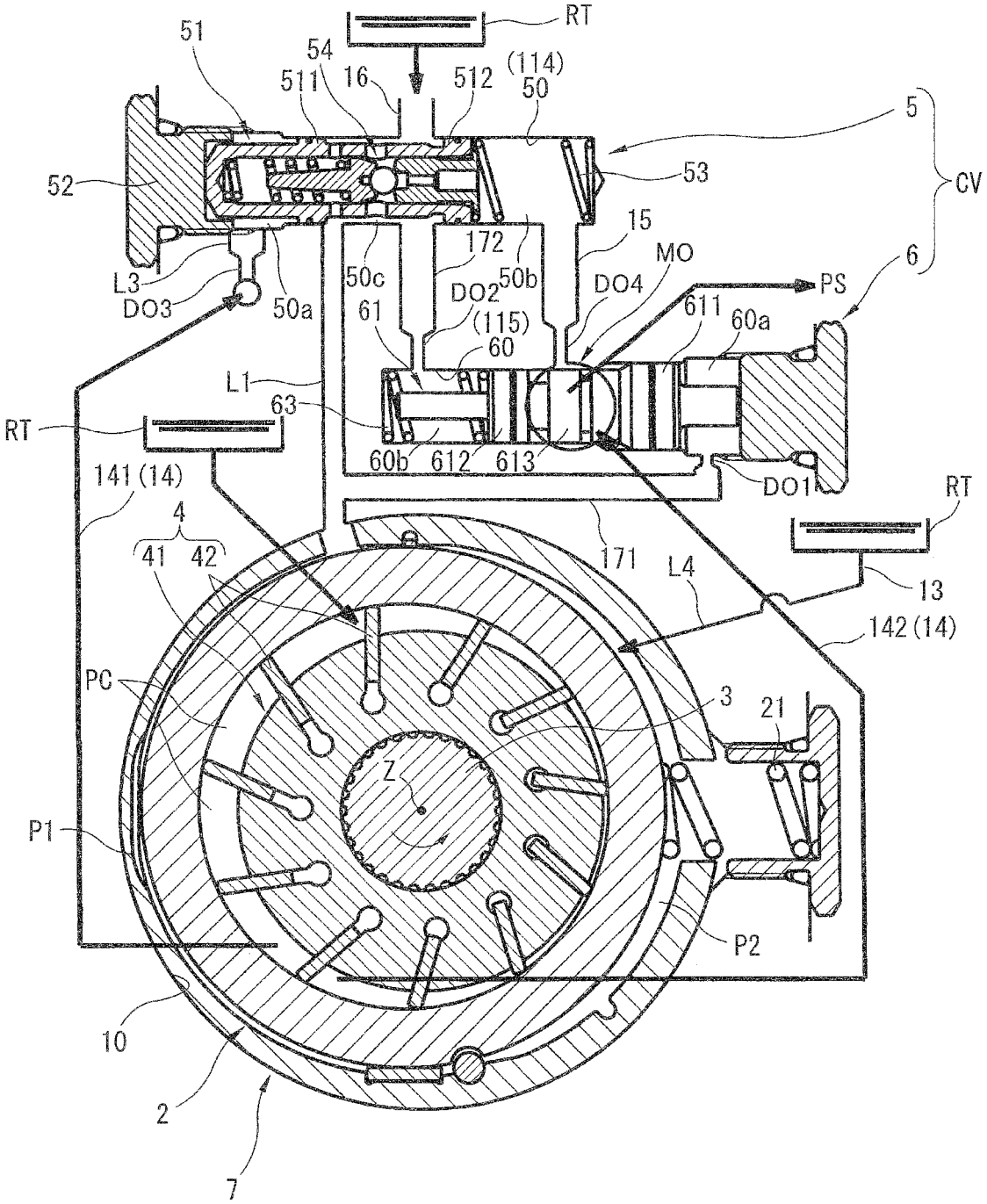
FIG. 1 is a schematic diagram showing a configuration of a variable displacement pump according to a first embodiment of the present invention.

FIG. 1 shows a schematic diagram of a configuration of a variable displacement pump according to a first embodiment of the present invention.

As shown in FIG. 1, the variable displacement pump according to the present embodiment includes: a cam ring 2 which is accommodated in the after-mentioned pump element accommodation part 10 so as to be able to eccentrically move; a pump element 4 which is rotatably disposed on the inner circumferential side of the cam ring 2 through the drive shaft 3; and a control unit CV used for controlling a discharge amount of hydraulic fluid accompanying the rotation driving of the pump element 4.

The cam ring 2 is accommodated on the inner circumferential side of a substantially annular adapter ring 7 fitted and fixed to the inner circumferential surface of the after-mentioned pump element accommodation part 10, so as to be able to eccentrically move in the right and left direction in FIG. 1 with respect to the rotation axis Z of the drive shaft 3.

In addition, by accommodating and disposing the cam ring 2 on the inner circumferential side of the adapter ring 7, the space between the adapter ring 7 and the cam ring 2 is partitioned into a first fluid pressure chamber P1 and a second fluid pressure chamber P2 used for the oscillation control of the cam ring 2. Then, a coil spring 21 that is a biasing member for biasing the cam ring 2 toward the first fluid pressure chamber P1 is provided inside the second fluid pressure chamber P2. That is, by the biasing force of the coil spring 21, the cam ring 2 is always biased toward the direction in which an eccentric amount to the rotation axis Z (hereinafter, simply referred to as "eccentric amount") becomes maximum.

The pump element 4 is configured of a disc-like rotor 41 rotatably accommodated on the inner circumferential side of the cam ring 2 and rotatably driven by the drive shaft 3 and a plurality of vanes 42 formed in rectangular plate shapes and accommodated on the outer circumferential side of the rotor 41 so as to retractably move toward the outer side in the radial direction. Then, each of the vanes 42 protrudes to the outer circumferential side of the rotor 41 with the rotation of the rotor 41 and slidably comes in contact with the inner circumferential surface of the cam ring 2, and a plurality of pump chambers PC, each of which is partitioned by a pair of vanes 42, 42 arranged adjacent to each other, are formed between the cam ring 2 and the rotor 41.

Specifically, in a region in which the volume of each pump chamber PC is enlarged (hereinafter, referred to as "suction region") with the rotation of the rotor 41, the hydraulic fluid stored in a reservoir tank RT is sucked through a suction passage 13. On the other hand, in a region in which the volume of each pump chamber PC is reduced (hereinafter, referred to as "discharge region", the hydraulic fluid which is compressed due to the reduction of the volume of each pump chamber PC is discharged toward the outside (power steering device PS) through a discharge passage 14 (the after-mentioned second discharge passage 142).

Then, the cam ring 2 oscillates in the right and left direction in FIG. 1, and a rate of variation in volume of each pump chamber PC with the rotation of the rotor 41 is increased or decreased, and consequently, the discharge amount (proper discharge amount) per one rotation of the pump element 4 varies. That is, the eccentric amount of the cam ring 2 becomes large by the shift of the cam ring 2 in the left direction in FIG. 1 (hereinafter, referred to as "eccentric direction"), and the proper discharge amount is increased. On the other hand, the eccentric amount of the cam ring 2 becomes small by the shift of the cam ring 2 in the right direction in FIG. 1 (hereinafter, referred to as "concentric direction"), and the proper discharge amount is decreased.

The control unit CV includes a first control valve 5 to be controlled based on the pressure on the upstream side and the pressure on the downstream side of a variable metering orifice MO provided to the discharge passage 14 (the after-mentioned second discharge passage 142), and a second control valve 6 configured to variably control the opening area of the variable metering orifice MO.

The first control valve 5 is configured by accommodating a first spool valve body 51, which is a valve body including two land parts (first land part 511, second land part 512), in a first valve accommodation chamber 50 having a constant diameter formed in a pump housing 1, so as to slidably move in a center axis X direction of the first spool valve body 51. The first valve accommodation chamber 50 is formed by sealing the opening end of a first spool valve accommodation hole 114 formed from one side with respect to a pump body 11 by a sealing member 52. Then, by the first spool valve body 51, the inside of the first valve accommodation chamber 50 is partitioned into a high pressure chamber 50*a* located more on the left side in FIG. 1 than the first land part 511, an intermediate pressure chamber 50*b* located more on the right side in FIG. 1 than the second land part 512 and a low pressure chamber 50*c* located between the first land part 511 and the second land part 512.

The pressure on the upstream side of the variable metering orifice MO is introduced into the high pressure chamber 50*a* through a first discharge passage 141 that is one of a bifurcated discharge passages 14 formed by branching on the downstream side of a first discharge port E1. On the other hand, a first coil spring 53 made of metal which biases the first spool valve body 51 toward the high pressure chamber 50*a* is accommodated and disposed in the intermediate pressure chamber 50*b*, and the pressure on the downstream side of the variable metering orifice MO is introduced into the intermediate pressure chamber 50*b* through a discharge pressure introduction passage 15 formed by branching from the second discharge passage 142 that is the other of the bifurcated discharge passages 14 formed by branching. Then, when the pressure difference between the high pressure chamber 50*a* and the intermediate pressure chamber 50*b* becomes a predetermined value or greater, the first spool valve body 51 moves to the right side in FIG. 1 against the biasing force of the first coil spring 53. In addition, the pressure inside the reservoir tank RT is introduced into the low pressure chamber 50*c* through a low pressure passage 16 communicating to the suction passage 13.

Here, each of the high pressure chamber 50*a* and the low pressure chamber 50*c* is configured so as to be able to communicate to the first fluid pressure chamber P1 through a first communication passage L1, such that this communication state can be switched by the first land part 511 of the first spool valve body 51. That is, in a state in which the first spool valve body 51 is located on the left side in FIG. 1, the low pressure chamber 50*c* communicates with the first fluid pressure chamber P1 through the first communication passage L1, and the pressure inside the reservoir tank RT is introduced into the first fluid pressure chamber P1. On the other hand, in a state in which the first spool valve body 51 is located on the right side in FIG. 1, the high pressure chamber 50*a* communicates with the first fluid pressure chamber P1 through the first communication passage L1, and the pressure on the upstream side of the variable metering orifice MO is introduced into the first fluid pressure chamber P1.

In addition, the first spool valve body 51 is provided with, in the inside thereof, a relief valve 54 for releasing the pressure inside the intermediate pressure chamber 50*b* by opening the intermediate pressure chamber 50*b* to the low pressure passage 16. This relief valve 54 is a so-called check valve, and when the pressure on the power steering device PS side that is a load side becomes a predetermined value or greater, it is opened to recirculate the pressure inside the intermediate pressure chamber 50*b* to the suction passage 13 through the low pressure passage 16 (see FIG. 2).

The second control valve 6 is configured by accommodating a second spool valve body 61, which is a valve body having three land parts (first land part 611, second land part 612, third land part 613), in a second valve accommodation chamber 60 formed in a step shape in the pump housing 1, so as to slidably move in a center axis Y direction of the second spool valve body 61. The second valve accommodation chamber 60 is formed by sealing the opening end of a second spool valve accommodation hole 115 formed from the other side with respect to the pump body 11 by a sealing member 62. Then, by the second spool valve body 61, the inside of the second valve accommodation chamber 60 is partitioned into a first pressure chamber 60*a* located more on the right side in FIG. 1 than the first land part 611 and a second pressure chamber 60*b* located more on the left side in FIG. 1 than the second land part 612.

The pressure inside the first fluid pressure chamber P1 is introduced into the first pressure chamber 60*a* through a first pressure introduction passage 171 formed by branching from the first communication passage L1. On the other hand, the pressure inside the suction passage 13 is introduced into the second pressure chamber 60*b* through a second pressure introduction passage 172 formed by branching from the low pressure passage 16. In addition, at this time, a first damper orifice DO1 and a second damper orifice DO2 that are throttle portions are respectively provided to the first pressure introduction passage 171 and the second pressure introduction passage 172.

Figure 2:
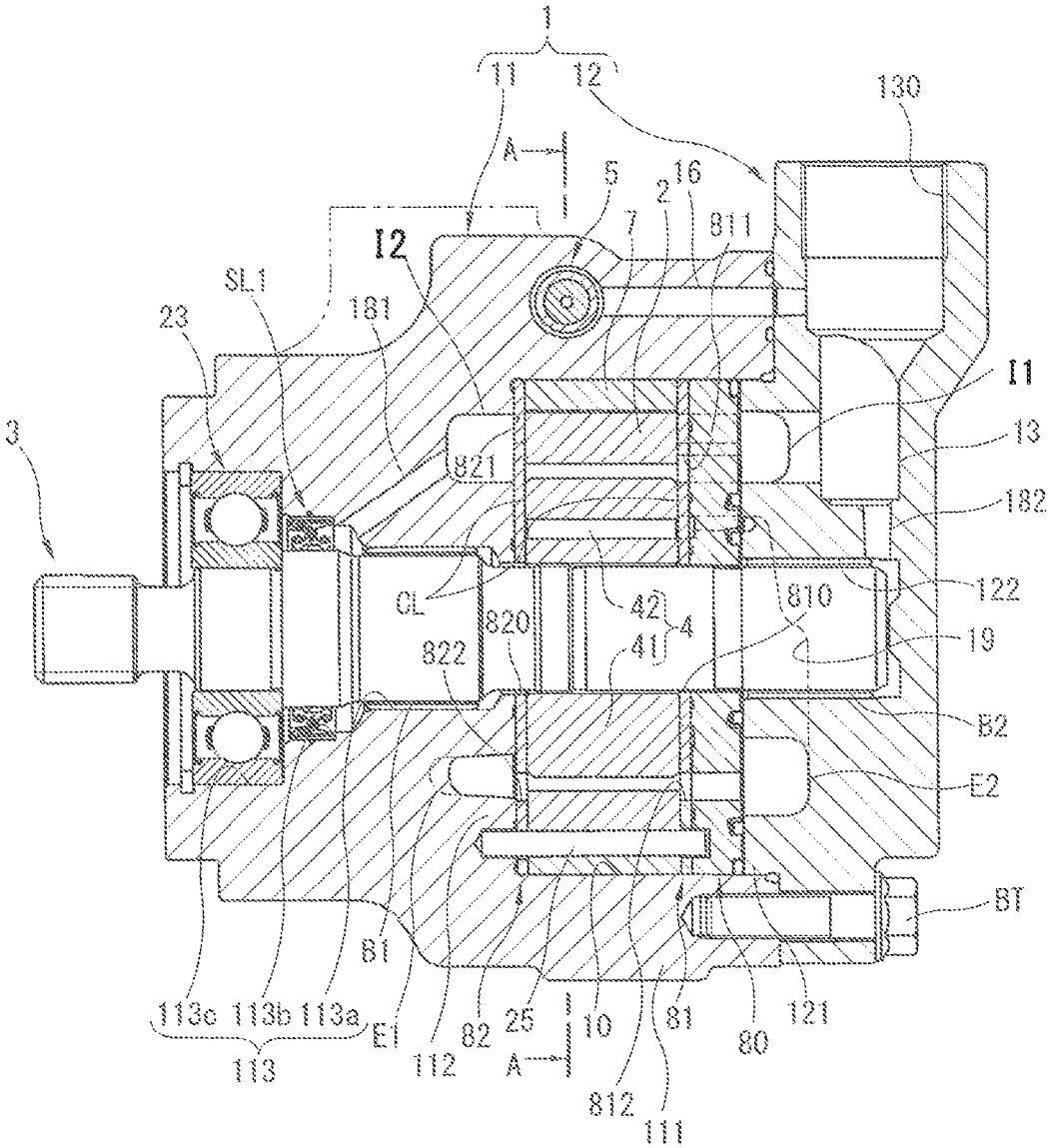
FIG. 2 is a longitudinal sectional view of the variable displacement pump shown in FIG. 1.

FIG. 2 shows a longitudinal sectional view of the variable displacement pump according to the present embodiment which is cut along the rotation axis Z of the drive shaft 3.

As shown in FIG. 2, the pump housing 1 is made of metal material and has a substantially cylindrical shape, such as aluminum alloy material, and includes the pump element accommodation part 10 inside thereof. More specifically, the pump housing 1 is configured of the pump body 11 that is a first housing, formed in a cylindrical shape having a bottom and formed with the pump element accommodation part 10 on the inner circumferential side thereof, and a pump cover 12 that is a second housing which closes the opening portion of the pump body 11. Then, the pump body 11 and the pump cover 12 are fasten to each other by a plurality of bolts BT.

The pump body 11 includes a cylindrical portion 111 formed in a substantially cylindrical shape and an end wall portion 112 as a bottom portion to close one end side in the axial direction (left side in FIG. 2) of the cylindrical portion 111, and by the cylindrical portion 111 and the end wall portion 112, the pump element accommodation part 10 is formed. Then, the adapter ring 7 is fitted and fixed to the inner circumferential surface of the pump element accommodation part 10, the cam ring 2 is accommodated on the inner circumferential side of the adapter ring 7, and the pump element 4 is accommodated on the inner circumferential side of the cam ring 2.

In addition, in the inside of the pump element accommodation part 10, a first plate member 81 and a second plate member 82 that are a pair of plate members are disposed on the both sides in the axial direction of the adapter ring 7, so as to face each other. By these first and second plate members 81 and 82, the pump element 4 is slidably sandwiched therebetween. Moreover, a pressure plate 80 is interposed between the first plate member 81 and the pump cover 12 (the after-mentioned fitting projection portion 121) on the side of the first plate member 81 opposite to the pump element 4.

The first plate member 81 is formed in a disk shape by press-forming a predetermined metal plate, and is formed with, on the surface thereof, a low friction coating film for reducing friction. With this, the sliding resistance and the seizure of the pump element 4 (rotor 41 and vanes 42) at the time of pump driving are reduced. In addition, a plurality of first suction port communication holes 811 used for communicating the pump chambers PC with the after-mentioned first suction port I1 are penetratingly formed to the first plate member 81 along the axial direction in the circumferential direction region corresponding to a suction region that is the outer circumferential region of a shaft penetrating hole 810 formed penetrating the center of the pump element accommodation part 10. Moreover, a plurality of second discharge ports 812 used for communicating the pump chambers PC with the after-mentioned second discharge port E2 are penetratingly formed to the first plate member 81 along the axial direction in the circumferential direction region corresponding to a discharge region.

In the same way as the first plate member 81, the second plate member 82 is formed in a disk shape by press-forming a predetermined metal plate, and is formed with, on the surface thereof, a low friction coating film. In addition, a second suction port communication hole 821 used for communicating the pump chambers PC with the after-mentioned second suction port I2 is penetratingly formed to the second plate member 82 along the axial direction in the circumferential direction region corresponding to a suction region that is the outer circumferential region of a shaft penetrating hole 820 formed penetrating the center. Moreover, a plurality of first discharge ports 822 used for communicating the pump chambers PC with the after-mentioned first discharge port E1 are penetratingly formed to the second plate member 82 along the axial direction in the circumferential direction region corresponding to a discharge region.

In addition, a shaft through hole 113 through which the drive shaft 3 penetrates is penetratingly formed to the end wall portion 112 along the axial direction in the center of the pump element accommodation part 10. The shaft through hole 113 is formed in a step shape whose diameter is enlarged stepwise toward the outer side in the axial direction (left side in FIG. 2). Specifically, the shaft through hole 113 includes a first bearing part 113*a* for rotatably supporting the middle part of the drive shaft 3 through a first bearing B1, a seal holding part 113*b* for holding a seal member SL1, and a bearing holding part 113*c* for holding ball bearings 23 for rotatably supporting one end side (left side in FIG. 2) in the axial direction of the drive shaft 3.

In the first bearing part 113*a*, a part of the hydraulic fluid leaking from the pump chambers PC through axial gaps CL between the first and second plate members 81 and 82 and the pump element 4 flows into the first bearing part 113*a* through the drive shaft 3, and consequently, the lubrication of the first bearing B1 is carried out. At this time, the hydraulic fluid flowing into the first bearing part 113*a* is stopped by the seal member SL1, and the leaking of the hydraulic fluid to the outside through the shaft through hole 113 is suppressed. In addition, the hydraulic fluid stopped by the seal member SL1 is recirculated to a suction side (the after-mentioned second suction port I2) through the after-mentioned first recirculation passage 181.

In addition, the second suction port I2 that is a suction hole opened to the pump chambers PC and is formed in a circular arcuate groove shape is formed to the inner-side end surface of the end wall portion 112 by cutting-out, in a predetermined circumferential direction region corresponding to a suction region that is the outer circumferential region of the shaft through hole 113. Moreover, the first recirculation passage 181 for recirculating the hydraulic fluid leaking from the pump chambers PC to the second suction port I2 by communicating the second suction port I2 with the end portion on the first bearing part 113*a* side of the seal holding part 113*b* is formed inside the end wall portion 112. Furthermore, the second suction port I2 is connected to the second fluid pressure chamber P2 through a low pressure introduction passage L4 (see FIG. 1), and the pressure of the suction passage 13 that is a suction pressure corresponding to the pressure inside the reservoir tank RT can be introduced into the second fluid pressure chamber P2 through the low pressure introduction passage L4.

In addition, similarly, the first discharge port E1 that is a discharge hole opened to the pump chambers PC and is formed in a circular arcuate groove shape is formed to the inner-side end surface of the end wall portion 112 by cutting-out, in a predetermined circumferential direction region corresponding to a discharge region. The first discharge port E1 is connected to the discharge passage 14 at a predetermined position in the circumferential direction.

The pump cover 12 has a substantially disk shape, and the fitting projection portion 121 fitted to the opening end portion on the other end side in the axial direction of the cylindrical portion 111 of the pump body 11 protrudes in a step shape and formed in the inner-side surface of the pomp cover 12 that faces the pump body 11. Then, in the end surface of the fitting projection portion 121, a second bearing part 122 for rotatably supporting the other end portion of the drive shaft 3 through a second bearing B2 is formed in a concave shape.

In the second bearing part 122, a part of the hydraulic fluid leaking from the pump chambers PC through the axial gaps CL between the first and second plate members 81 and 82 and the pump element 4 flows into the second bearing part 122 through the drive shaft 3, and consequently, the lubrication of the second bearing B2 is carried out. Here, the second bearing part 122 is configured so as to be able to communicate with the suction passage 13 through a second recirculation passage 182, and the hydraulic fluid flowing into the second bearing part 122 is recirculated to a suction side (the after-mentioned first suction port I1).

In addition, the first suction port I1 that is a suction hole opened to the pump chambers PC and is formed in a circular arcuate groove shape is formed to the end surface of the fitting projection portion 121 by cutting-out, in a predetermined circumferential direction region corresponding to a suction region that is the outer circumferential region of the second bearing part 122. The first suction port I1 communicates with the suction passage 13 through a first suction hole 123 penetratingly formed at a predetermined position in the circumferential direction of the first suction port I1, and the hydraulic fluid stored in the reservoir tank RT (see FIG. 1) can be sucked through the suction passage 13.

In addition, a pump suction hole 130 used for the suction of the hydraulic fluid to the inside of the pump housing 1 is formed and opened to the outside at the upstream end portion of the suction passage 13, and the hydraulic fluid is sucked from the reservoir tank RT (see FIG. 1) through a pipe (not shown in the drawings) which is connected to the pump suction hole 130.

In addition, similarly, the second discharge port E2 that is a discharge hole opened to the pump chambers PC and is formed in a circular arcuate groove shape is formed to the end surface of the fitting projection portion 121 by cutting-out, in a predetermined circumferential direction region corresponding to a discharge region. The second discharge port E2 is connected to a discharge pressure introduction passage 19 for supplying the hydraulic fluid discharged to the second discharge port E2 to the after-mentioned back pressure grooves 412, at a predetermined position in the circumferential direction.

The drive shaft 3 is disposed penetrating the pump body 11 through the shaft through hole 113 so as to pass through the center of the pump element accommodation part 10, and is rotatably supported thereon through the first and second bearings B1 and B2 and the ball bearings 23. Then, the drive shaft 3 rotates based on the driving force of an engine (not shown in the drawings) which is transmitted through a gear or a spline (not shown in the drawings) which is fitted to one end portion thereof in the axial direction and which exposes to the outside of the pump housing 1 through the shaft though hole 113.

Figure 3:
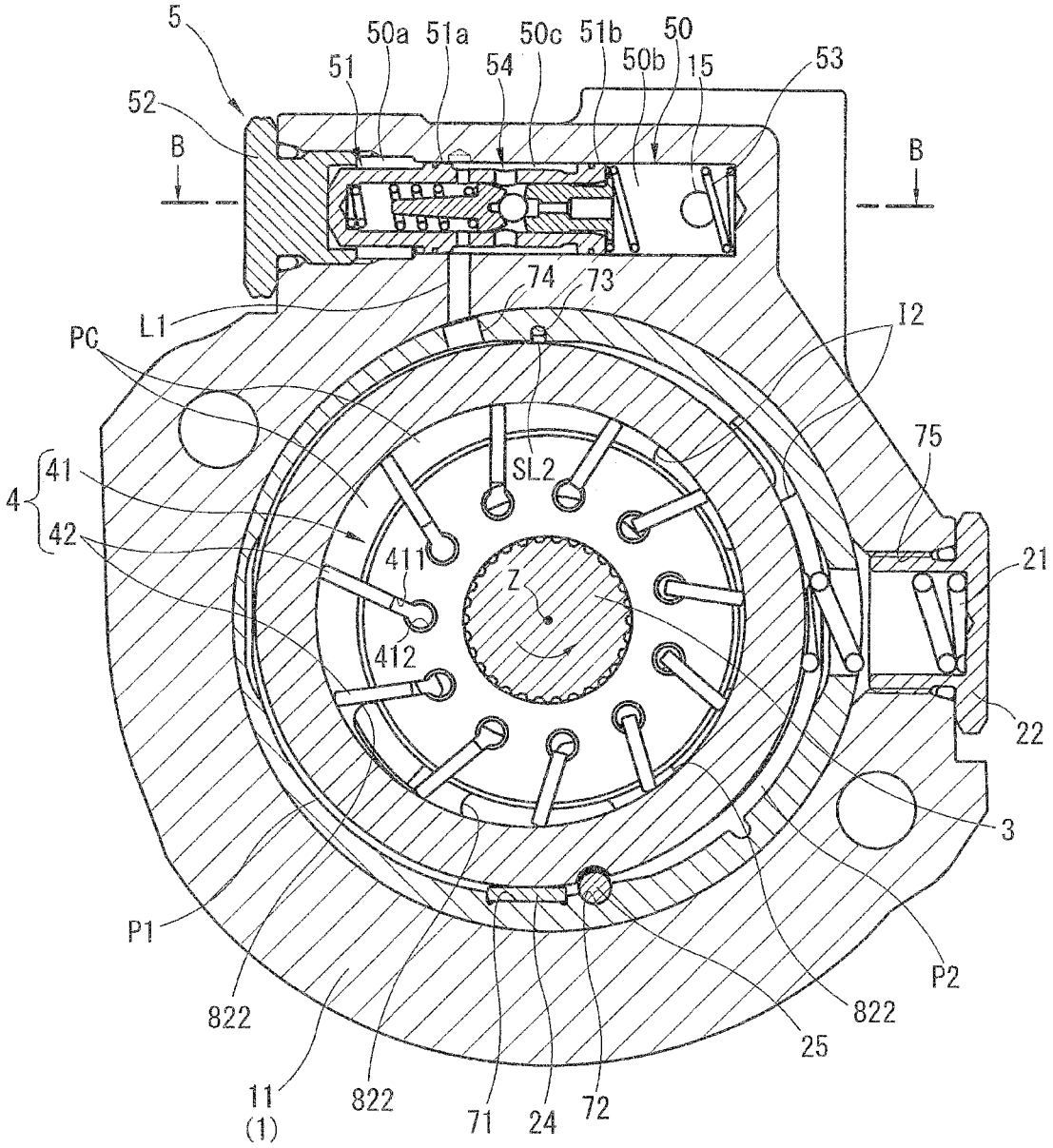
FIG. 3 is a linear sectional view taken along a line A-A of FIG. 2.

FIG. 3 shows a sectional view of the variable displacement pump which is cut along a line A-A of FIG. 2.

As shown in FIG. 3, the annular cam ring 2 is accommodated on the inner circumferential side of the annular adaptor ring 7 fitted and fixed to the inner circumferential surface of the pump element accommodation part 10 of the pump housing 1 (pump body 11), so as to be eccentrically movable with respect to the rotation axis Z of the drive shaft 3. In addition, the pump element 4 formed of the disk-like rotor 41 and a plurality of the vanes 42 each having a rectangular plate shape is accommodated on the inner circumferential side of the cam ring 2, so as to be rotatable and drivable through the drive shaft 3.

In the adapter ring 7, a vane holding groove 71 having a rectangular concave shape in cross section is formed by cutting-out along the axial direction, at a predetermined position in the circumferential direction on the inner circumferential side of the adapter ring 7, and a plate member 24 having a rectangular shape in cross section that becomes an oscillation fulcrum of the cam ring 2 is fitted and fixed to the inside of the vane holding groove 71. Moreover, a pin holding groove 72 having a substantially semicircular shape in cross section is formed on the inner circumferential side of the adapter ring 7 along the axial direction by cutting-out, so as to be adjacent to the vane holding groove 71, and a rod-shaped pin member 25 for regulating the movement in the concentric direction of the cam ring 2 is held inside the pin holding groove 72.

In addition, a seal holding groove 73 for holding a seal member SL2 is formed on the inner circumferential side of the adapter ring 7 along the axial direction by cutting-out, at a position substantially radially opposite to the plate member 24, and the seal member SL2 that partitions both side spaces of the cam ring 2 is held inside the seal holding groove 73. That is, by these seal member SL2 and plate member 24, the space between the adapter ring 7 and the cam ring 2 is partitioned into the first fluid pressure chamber P1 and the second fluid pressure chamber P2.

In addition, a communication hole 74 for communicating the first communication passage L1 formed inside the pump body 11 and the first fluid pressure chamber P1 is radially penetratingly formed to the circumferential wall of the adapter ring 7. That is, the pressure inside the reservoir tank RT introduced through the first communication passage L1 from the first control valve 5 side or the pressure on the upstream side of the variable metering orifice MO can be introduced into the first fluid pressure chamber P1 through the communication hole 74.

In addition, a spring through hole 75 through which the coil spring 21 passes is penetratingly formed to the circumferential wall of the adapter ring 7 along the radial direction, and one end of the coil spring 21 is able to come in contact with the cam ring 2 through the spring through hole 75. In addition, the other end of the coil spring 21 is supported on a bolt-shaped retainer member 22 screwed and fixed to the circumferential wall of the pump body 11, and the coil spring 21 always biases the cam ring 2 in the eccentric direction based on a set load.

The cam ring 2 is provided so as to be able to roll on the plate member 24 in the eccentric direction and the concentric direction, and the rolling of the cam ring 2 caused by sliding on the plate member 24 is regulated by engaging an engaging groove 20 having a substantially semicircular shape in cross section and formed on the outer circumferential side of the cam ring 2 by cutting-out with the pin member 25 with the rolling in the concentric direction.

The rotor 41 is integrally rotatably fixed to the outer circumferential side of the drive shaft 3 by spline-fitting. In addition, by cutting-out, a plurality of slits 411 opening toward the outer circumferential of the rotor 41 are radially formed to the outer circumferential part of the rotor 41 at equal interval positions in the circumferential direction. That is, the vanes 42 are respectively accommodated in the slits 411 so as to be retractable toward the outside of the rotor 41.

In addition, in the inner circumferential-side end portions of the slits 411, the back pressure grooves 412 each having a substantially semicircular shape in cross section are continuously formed along the axial direction. That is, the vanes 42 protrude to the outer circumference side of the rotor 41 by acting discharge pressure to be introduced into the back pressure grooves 412 on the inner end sides of the vanes 42, in addition to the centrifugal force generated by the rotation of the rotor 41.

Figure 4:
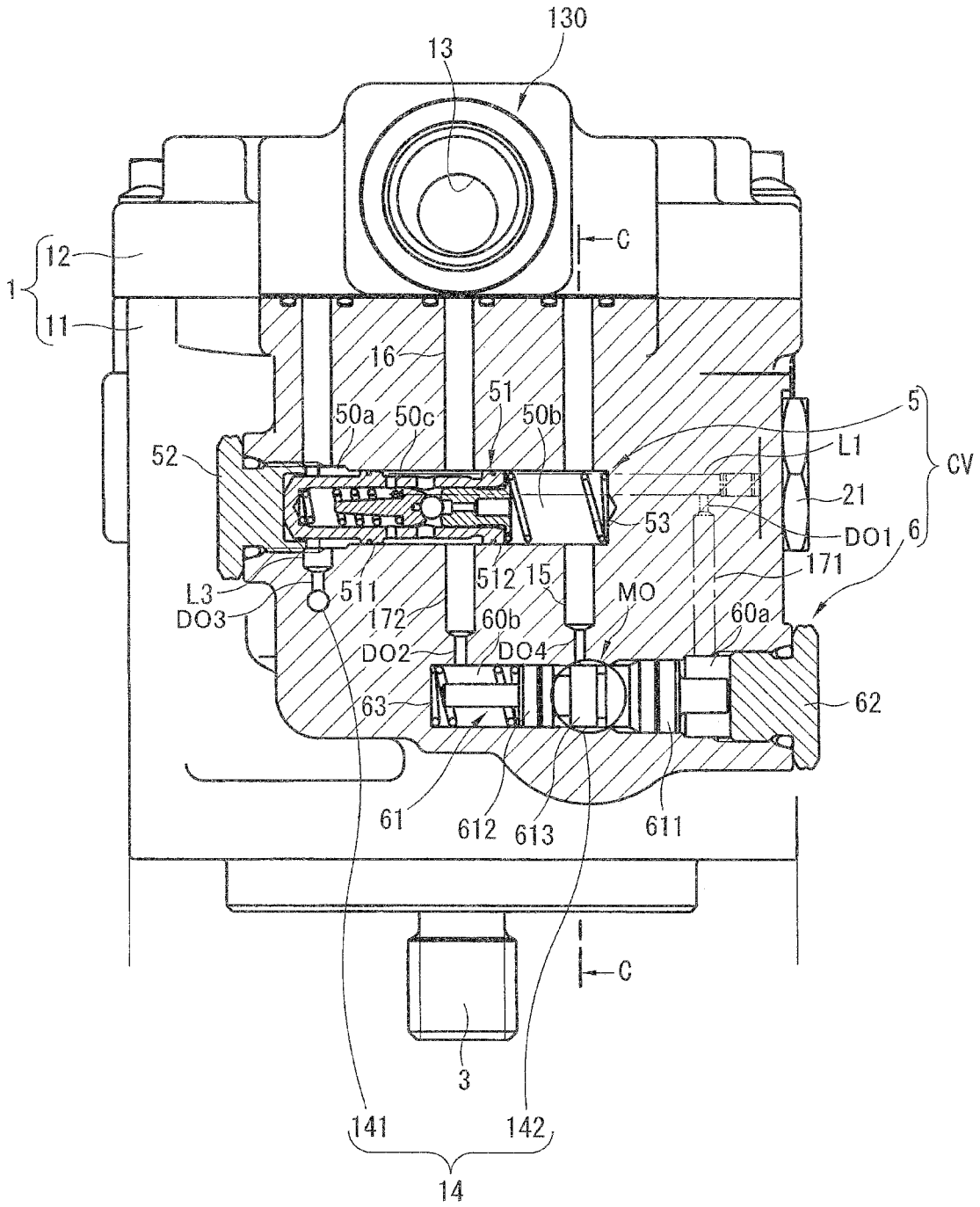
FIG. 4 is a linear sectional view taken along a line B-B of FIG. 2.
Figure 5:
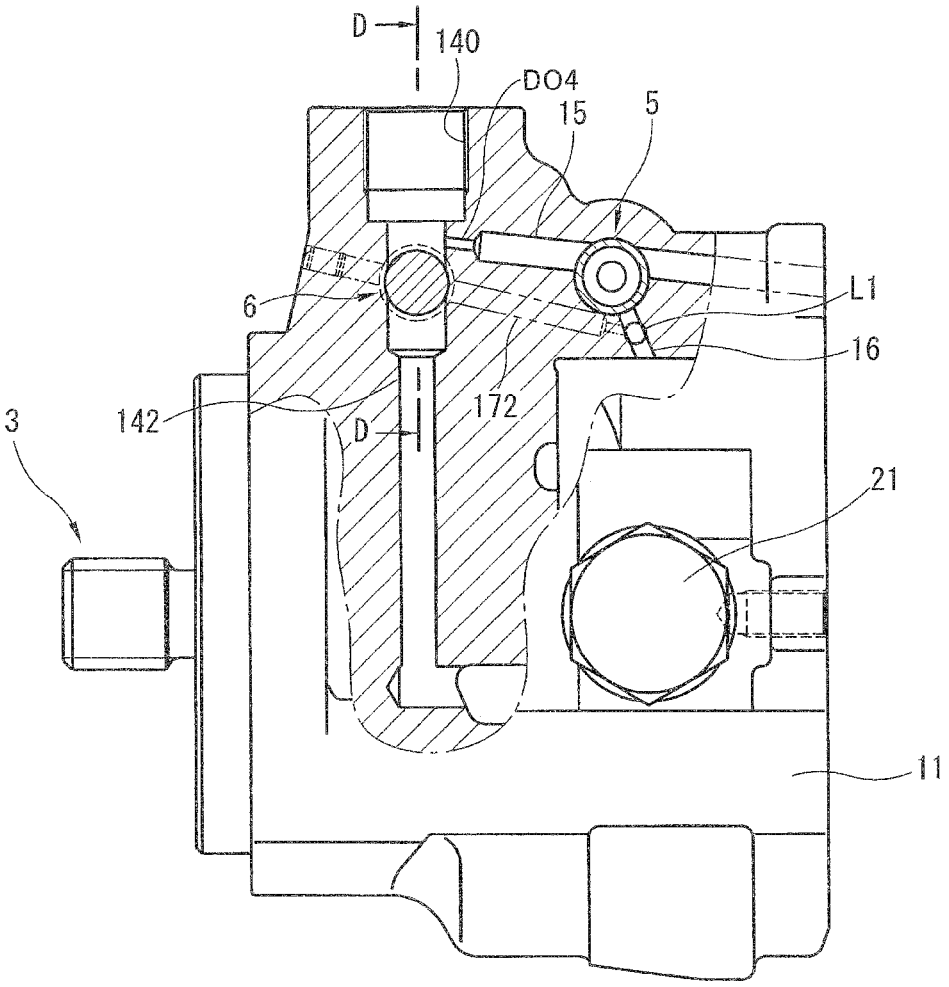
FIG. 5 is a linear sectional view taken along a line C-C of FIG. 4.

FIG. 4 shows a sectional view of the variable displacement pump which is cut along a line B-B of FIG. 3. FIG. 5 is a sectional view of the variable displacement pump which is cut along a line C-C of FIG. 4.

As shown in FIG. 4, the first control valve 5 and the second control valve 6 are arranged parallel to each other along the axial direction at substantially the same positions at the upper end part of the pump body 11. That is, the low pressure chamber 50*c* of the first control valve 5 and the second pressure chamber 60*b* of the second control valve 6 are provided so as to face each other in the axial direction, and the intermediate pressure chamber 50*b* of the first control valve 5 and the variable metering orifice MO variably controlled by the second control valve 6 are provided so as to face each other in the axial direction.

The pressure on the upstream side of the variable metering orifice MO is introduced into the high pressure chamber 50*a* of the first control valve 5 through a high pressure introduction passage L3 formed by branching from the first discharge passage 141. In addition, as shown in FIG. 4 and FIG. 5, the pressure (discharge pressure) on the downstream side of the variable metering orifice MO is introduced into the intermediate pressure chamber 50*b* of the first control valve 5 through the discharge pressure introduction passage 15 formed by branching from the second discharge passage 142. Moreover, the pressure (suction pressure) inside the reservoir tank RT is introduced into the low pressure chamber 50*c* of the first control valve 5 through the low pressure passage 16. In addition, the high pressure introduction passage L3 and the discharge pressure introduction passage 15 are respectively provided with a high pressure-side damper orifice DO3 and an intermediate pressure-side damper orifice DO4 that are throttle portions, and by each of these damper orifices DO3 and DO4, the vibration of the first spool valve body 51 is suppressed.

Figure 6:
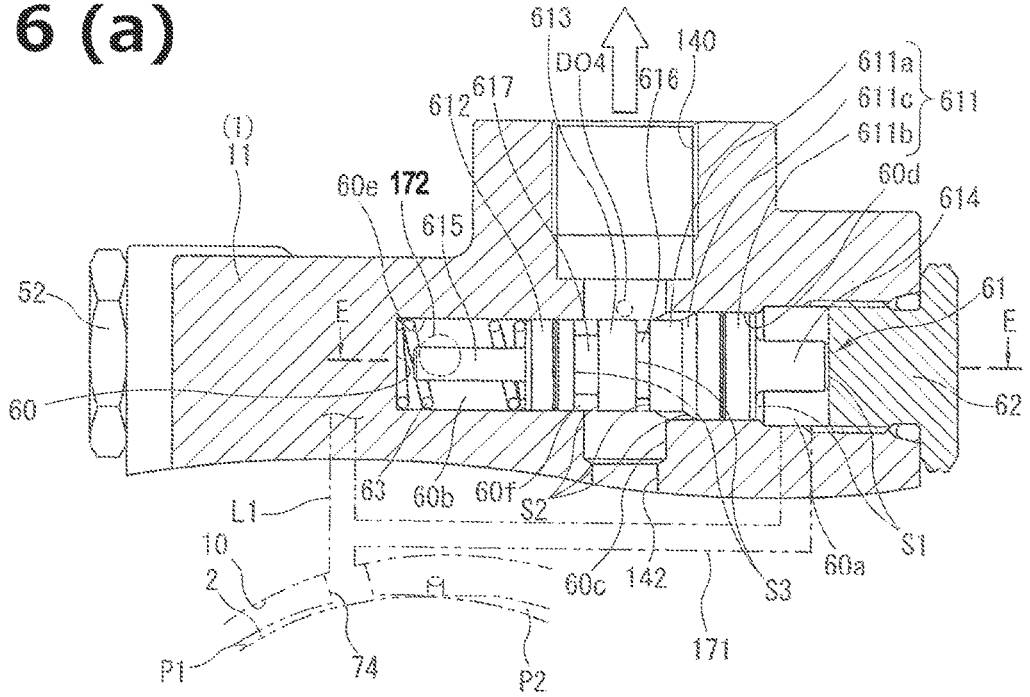
FIG. 6(*a*) is a linear sectional view taken along a line D-D of FIG. 5, and FIG. 6(*b*) is a linear sectional view taken along a line E-E of FIG. 6(*a*).
Figure 6:
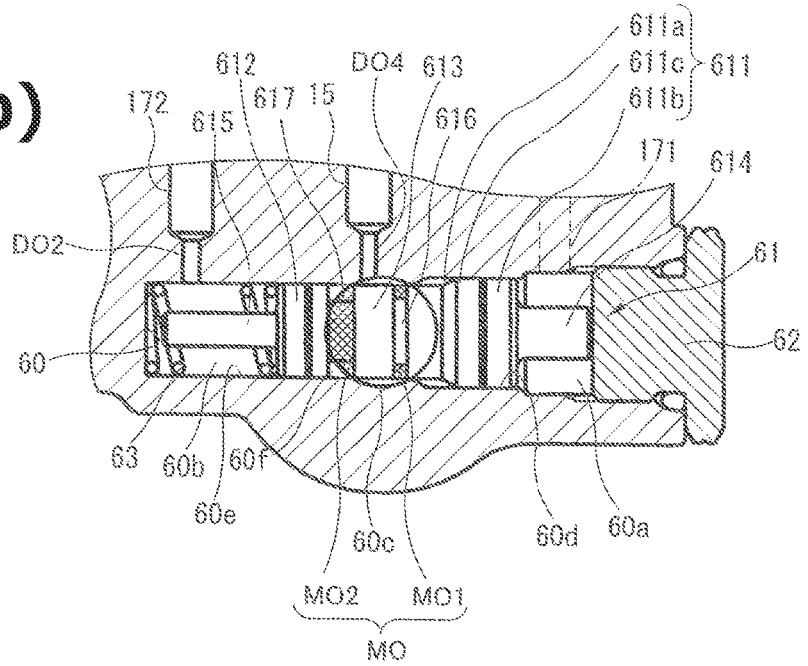

The pressure inside the first fluid pressure chamber P1 is introduced into the first pressure chamber 60*a* of the second control valve 6 through the first pressure introduction passage 171 formed by branching from the first communication passage L1 (see FIG. 1 and FIG. 6). In addition, the pressure inside the reservoir tank RT is introduced into the second pressure chamber 60*b* of the second control valve 6 through the second pressure introduction passage 172 formed by branching from the low pressure passage 16. In addition, the first pressure introduction passage 171 and the second pressure introduction passage 172 are respectively provided with the first damper orifice DO1 and the second damper orifice DO2 that are throttle portions, and by each of these damper orifices DO1 and DO2, the vibration of the second spool valve body 61 is suppressed.

FIG. 6 is a longitudinal sectional view of the second control valve 6. FIG. 6(*a*) shows a sectional view taken along a line D-D of FIG. 5, and FIG. 6 (*b*) shows a sectional view taken along a line E-E of FIG. 6(*a*). In addition, in the explanation of the present drawings, it is explained that, in each of the drawings, the right side is one end side and the left side is other end side.

As shown in FIG. 6, the second control valve 6 is one for variably controlling the opening area of a discharge passage opening part 60*e* of the second valve accommodation chamber 60, which has a substantially circular shape in cross section and which is opened to the second discharge passage 142, by the second spool valve body 61 which slides inside the second valve accommodation chamber 60 of the pump body 11. In other words, the variable metering orifice MO is configured of the discharge passage opening part 60*c* opened to the second valve accommodation chamber 60 and the second spool valve body 61 for changing the opening area of the discharge passage opening part 60*c*.

Here, the variable metering orifice MO includes a fixed orifice portion MO1 which is opened to the second discharge passage 142 in a state in which the second spool valve body 61 maximumly moves to the one end side and a variable orifice portion MO2 in which the opening area of the second discharge passage 142 is varied to be reduced with the movement of the second spool valve body 61 to the other end side. That is, in a state in which the second spool valve body 61 maximumly moves to the one end side, the opening area of the variable orifice portion MO2 becomes maximum, and then the opening area of the variable metering orifice MO together with the opening area of the fixed orifice portion MO1 becomes maximum. On the other hand, in a state in which the second spool valve body 61 maximumly moves to the other end side, the opening area of the variable orifice portion MO2 becomes minimum, and then the opening area of the variable metering orifice MO together with the opening area of the fixed orifice portion MO1 becomes minimum.

In addition, a pump discharge hole 140 used for discharging the hydraulic fluid to the outside of the pump housing 1 is formed to be opened to the outside at the downstream end portion of the second discharge passage 142, and the discharged hydraulic fluid is supplied to the power steering device PS (not shown in the drawings), through a pipe (not shown in the drawings) connected to the pump discharge hole 140.

The second valve accommodation chamber 60 is formed by closing the opening part of the second spool valve accommodation hole 115 with the bolt-shaped sealing member 62, second spool valve accommodation hole 115 which is provided so as to extend across the second discharge passage 142 from the side of the pump body 11. Then, this second valve accommodation chamber 60 includes a large diameter part 60*d* which is located more on the one end side than the second discharge passage 142 and which has a step shape whose diameter is enlarged stepwise toward the one end side (right side in FIG. 6), a small diameter part 60*e* located more on the other end side than the second discharge passage 142, and a passage part 60*f* which is formed between the large diameter part 60*d* and the small diameter part 60*e* and which faces the second discharge passage 142.

The second spool valve body 61 integrally includes the first land part 611 provided on the one end side, the second land part 612 provided on the other end side and the third land part 613 provided in the middle part between the one end side and the other end side, and is accommodated in the second valve accommodation chamber 60 so as to be slidable along the center axis Y direction. In addition, at that time, the first land part 611 slides inside the large diameter part 60*d*, and the second land part 612 slides inside the small diameter part 60*e*, and the third land part 613 slides inside the passage part 60*f*.

Here, the first land part 611 has a step shape whose diameter is enlarged stepwise toward the one end side, and includes a small diameter portion 611*a* formed on the other end side so as to have substantially the same diameter as those of the second and third land parts 612 and 613, a large diameter portion 611*b* formed on the one end side by enlarging the diameter thereof in a step shape with respect to the small diameter portion 611*a*, and a step portion 611*c* formed between the small diameter portion 611*a* and the large diameter portion 611*b*. In addition, the step portion 611*c* is formed in a conical tapered shape inclined upward from the small diameter portion 611*a* side to the large diameter portion 611*b* side.

In addition, a first shaft part 614 regulating the maximum positon on the one end side of the second spool valve body 61 by coming in contact with the distal end of the sealing member 62 is formed on the one end side of the first land part 611 so as to project. On the other hand, a second shaft part 615 regulating the maximum positon on the other end side of the second spool valve body 61 by coming in contact with the end wall of the second valve accommodation chamber 60 is formed on the other end side of the second land part 612 so as to project. Moreover, the first land part 611 and the third land part 613 are connected with each other by a third shaft part 616 having a smaller diameter than those of the both land parts 611 and 613. In addition, the second land part 612 and the third land part 613 are connected with each other by a fourth shaft part 617 having a smaller diameter than those of the both land parts 612 and 613.

In addition, the second spool valve body 61 is accommodated and disposed inside the second valve accommodation chamber 60, and the second valve accommodation chamber 60 is partitioned into the first pressure chamber 60*a* formed more on the one end side than the first land part 611 and the second pressure chamber 60*b* formed more on the other end side than the second land part 612. Further, the pressure inside the first fluid pressure chamber P1 is introduced into the first pressure chamber 60*a* through the first pressure introduction passage 171 formed by branching from the first communication passage L1. On the other hand, a second coil spring 63 made of metal which biases the second spool valve body 61 toward the first pressure chamber 60*a* is accommodated and disposed inside the second pressure chamber 60*b*, and the pressure inside the reservoir tank RT is introduced into the second pressure chamber 60*b* through the second pressure introduction passage 172 formed by branching from the low pressure passage 16.

In addition, the second spool valve body 61 includes, on the one end side of the first land part 611, a first pressure receiving portion S1 on which the pressure of the first fluid pressure chamber P1 introduced into the first pressure chamber 60*a* acts. The first pressure receiving portion S1 is configured of the end surface on the one end side of the first land part 611 and the end surface of the first shaft part 614.

In addition, the second spool valve body 61 includes, on the other end side of the first land part 611, a second pressure receiving portion S2 for biasing the second spool valve body 61 in the direction in which the opening area of the variable metering orifice MO increases by the act of the pressure of the downstream side of the variable metering orifice MO, which flows through the passage part 60*c*. The second pressure receiving portion S2 is configured of the end surface of the small diameter portion 611*a* of the first land part 611, the step portion 611*c* of the first land part 611 and the end surface on the other end side of the third land part 613.

In addition, the second spool valve body 61 includes, on the one end side of the second land part 612, a third pressure receiving portion S3 which has a smaller pressure receiving area than that of the second pressure receiving portion S1, and which biases the second spool valve body 61 in the direction, in which the opening area of the variable metering orifice MO decreases, by the act of the pressure on the downstream side of the variable metering orifice MO. The third pressure receiving portion S3 is configured of the end surface on the one end side of the second land part 612 and the end surface on the one end side of the third land part 613.

Based on the above configuration, the second control valve 6 includes a thrust imparting mechanism TM for imparting thrust to the second spool valve body 61 in the direction in which the opening area of the variable metering orifice MO increases, with the rise in the pressure on the downstream side of the variable metering orifice MO. The thrust imparting mechanism TM is configured of the second pressure receiving portion S2 for biasing the second spool valve body 61 to the one end side and the step portion 611*c* of the second pressure receiving portion S2 that is the pressure receiving area difference between the second pressure receiving portion S2 and the third pressure receiving portion S3 for biasing the second spool valve body 61 to the other end side. That is, when the pressure on the downstream side of the variable metering orifice MO rises, the pressure acts on the first, second, and third land parts 611, 612 and 613, and as this result, by the pressure receiving area difference between the second pressure receiving portion S2 and the third pressure receiving portion S3, the thrust to the one end side is imparted to the second spool valve body 61.

The second coil spring 63 is inserted into the space between the end surface on the other end side of the second land part 612 and the end wall of the second valve accommodation chamber 60 with a predetermined set load (preload), so as to surround the outer circumferential side of the second shaft part 615, and always biases the second spool valve body 61 to the one end side by a biasing force based on this set load.

Explanation of Operation of Variable Displacement Pump

Figure 7:
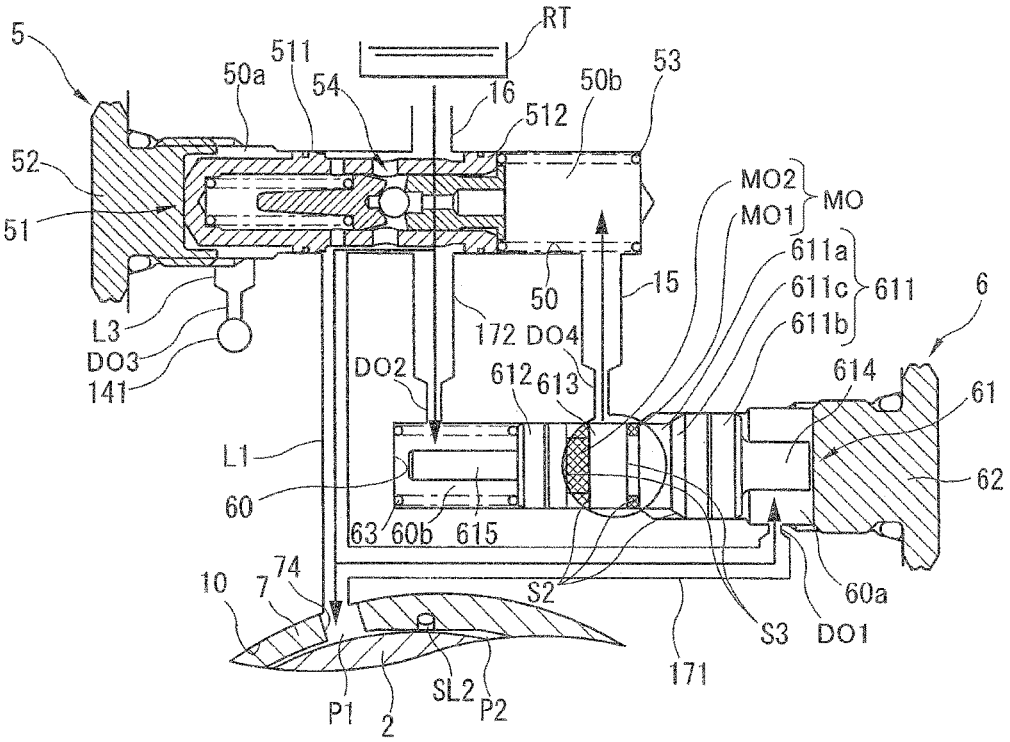
FIG. 7 is enlarged views of a first control valve and a second control valve shown in FIG. 1.
Figure 7:
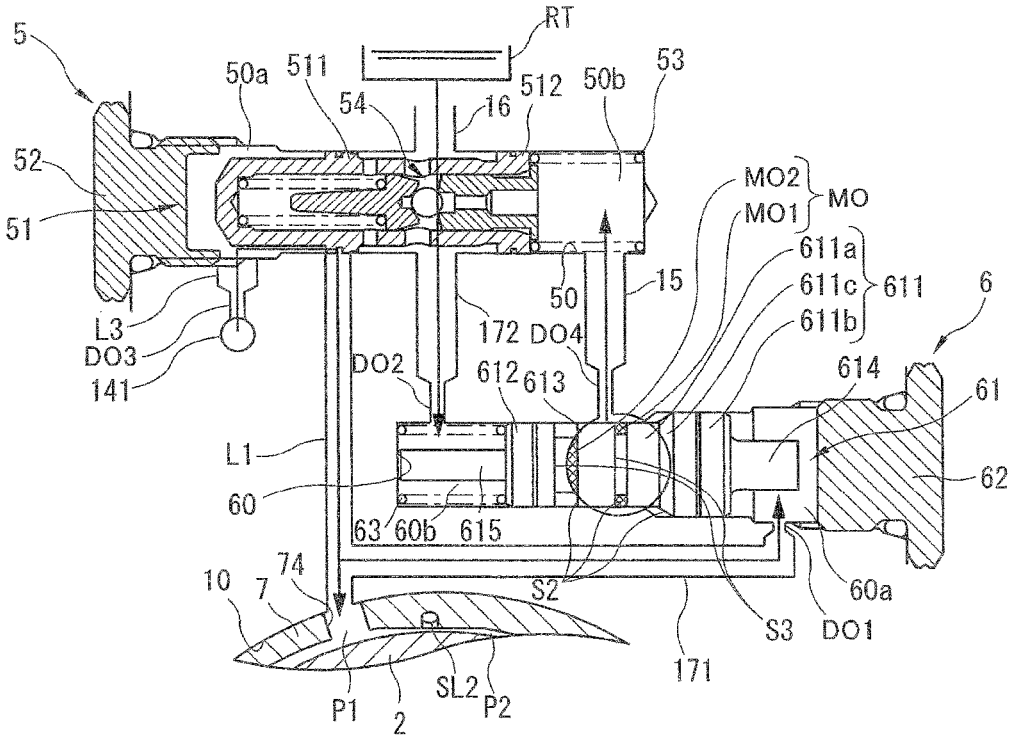

FIG. 7 is enlarged views of the first control valve 5 and the second control valve 6 shown in FIG. 1, and FIG. 7(*a*) shows a state in which engine speed is low and FIG. 7(*b*) shows a state in which engine speed is high.

First, as shown in FIG. 7(*a*), in a state in which the rotation speed of the engine (not shown in the drawings) is low, the pressure of the hydraulic fluid to be discharged from a first discharge port (not shown in the drawings) becomes small, and consequently, the pressure difference (front-back differential pressure) between the upstream side and the downstream side of the variable metering orifice MO also becomes small. With this, in the first control valve 5, the biasing force of the first coil spring 53 overcomes a biasing force based on the front-back differential pressure of the variable metering orifice MO, and the first spool valve body 51 becomes a state of being maximally displaced to the high pressure chamber 50*a* side by the biasing force of the first coil spring 53. As that result, the pressure inside the reservoir tank RT that is a low pressure is introduced into the first fluid pressure chamber P1 through the first communication passage L1, and the cam ring (not shown in the drawings) moves in the eccentric direction by the biasing force of the coil spring 21.

On the other hand, in the second control valve 6, the pressure inside the reservoir tank RT that is a low pressure is introduced into the first pressure chamber 60*a* through the first pressure introduction passage 171 branching from the first communication passage L1. With this, the biasing force of the second coil spring 63 overcomes the pressure inside the first pressure chamber 60*a*, and the second spool valve body 61 becomes a state of being displaced to the first pressure chamber 60*a* side by the biasing force of the second coil spring 63. Consequently, the opening area of the variable orifice portion MO2 increases, and the whole opening area of the variable metering orifice MO increases.

As the above, in the state in which the rotation speed of the engine (not shown in the drawings) is low, the proper discharge amount of the pump becomes large due to the increase of the eccentric amount of the cam ring (not shown in the drawings), and with this, the opening area of the variable metering orifice MO increases, and the discharge amount of the pump becomes large. Accordingly, in a state in which the rotation speed of the engine (not shown in the drawings) is low and vehicle speed is low, the generation of a large steering assist torque becomes possible, thereby relatively largely assisting the steering at the time of, for example, parking.

In addition, as shown in FIG. 7(*b*), in a state in which the rotation speed of the engine (not shown in the drawings) is high, the flow rate of the hydraulic fluid to be discharged from the first discharge port (not shown in the drawings) increases, and consequently, the pressure difference (front-back differential pressure) between the upstream side and the downstream side of the variable metering orifice MO also becomes large. With this, in the first control valve 5, the biasing force based on the front-back differential pressure of the variable metering orifice MO overcomes the biasing force of the first coil spring 53, and the first spool valve body 51 becomes a state of being displaced to the intermediate pressure chamber 50*b* side against the biasing force of the first coil spring 53. As that result, the pressure inside the high pressure chamber 50*a* that is a high pressure is introduced into the first fluid pressure chamber P1 through the first communication passage L1, and the cam ring (not shown in this drawing) moves in the concentric direction against the biasing force of the coil spring 21.

On the other hand, in the second control valve 6, the pressure inside the high pressure chamber 50*a* that is a high pressure is introduced into the first pressure chamber 60*a* through the first pressure introduction passage 171 branching from the first communication passage L1. With this, the biasing force based on the pressure inside the first pressure chamber 60*a* overcomes the biasing force of the second coil spring 63, and the second spool valve body 61 becomes a state of being displaced to the second pressure chamber 60*b* side by the biasing force based on the pressure inside the first pressure chamber 60*a*. As that result, the opening area of the variable orifice portion MO2 decreases, and the whole opening area of the variable metering orifice MO decreases.

As the above, in the state in which the rotation speed of the engine (not shown in the drawings) is high, the proper discharge amount of the pump becomes small due to the decrease of the eccentric amount of the cam ring (not shown in this drawing), and the opening area of the variable metering orifice MO decreases, and consequently, the discharge amount of the pump becomes small. Accordingly, in a state in which the rotation speed of the engine (now shown in the drawings) is high and vehicle speed is high, steering stability during, for example, high speed traveling can be improved by decreasing a steering assist torque, and energy conservation can be archived by regulating the generation of a wasteful steering assist torque.

In addition, in a state in which the opening area of the variable metering orifice MO decreases, there is a case where the pressure on the power steering device PS (not shown in the drawings) side that is a load side increases, and the pressure on the downstream side of the variable metering orifice MO increases. In this case, by the pressure receiving area difference between the second pressure receiving portion S2 and the third pressure receiving portion S3, the increased pressure on the downstream side of the variable metering orifice MO acts on the step portion 611*c* of the second pressure receiving portion S2 of the second spool valve body 61 in the second control valve 6, and with this pressure, thrust toward the first pressure chamber 60*a* is imparted to the second spool valve body 61. Consequently, the second spool valve body 61 moves toward the first pressure chamber 60*a*, and the opening area of the variable metering orifice MO increases, and thereby an steering assist torque corresponding to the increased pressure on the load side can be generated.

Moreover, in a case of a port timing in which a larger discharge region is assigned to the second fluid pressure chamber P2 side in the circumferential region, by the pressure inside the pump chambers PC in the discharge region, the cam ring 2 is biased toward the second fluid pressure P2, that is, in the concentric direction, and by this biasing force, the proper discharge amount also decreases. However, in the present embodiment, since the thrust imparting mechanism TM is configured by forming the first land part 611 of the second spool valve body 61 in the above-mentioned step shape, there are merits that a discharge flow rate increases with the increase of the load pressure, and with this, the decrease of the proper discharge amount due to the increase of the discharge flow rate can be suppressed.

Working Effect of the Present Embodiment

As mentioned above, in a conventional variable displacement pump, the opening area of a variable metering orifice varies in accordance with the moving amount of a cam ring. In this case, since the moving amount of the cam ring is minute, a range of variation in the opening area of the variable metering orifice cannot be largely ensured. Therefore, in the conventional variable displacement pump, the range of variation in the moving amount of the cam ring, that is, the variation range of a proper discharge amount is limited, and as a result of this, sufficient energy conservation cannot be achieved.

In contrast to this, in the variable displacement pump according to the present embodiment, by achieving the following effects, problems arising in the conventional variable displacement pump can be solved.

The variable displacement pump according to the present invention includes: a pump housing 1 having a pump element accommodation part 10 thereinside; a cam ring 2 formed in an annular shape and provided inside the pump element accommodation part 10; a pump element 4 rotatably provided inside the cam ring 2 and configured to carry out suction and discharge of hydraulic fluid; a first fluid pressure chamber P1 and a second fluid pressure chamber P2 that are a pair of spaces provided between the pump element accommodation part 10 and the cam ring 2, wherein by acting a pressure of at least the first fluid pressure chamber P1 on the cam ring 2, the cam ring 2 is driven, and a proper discharge amount that is a discharge amount per one rotation of the pump element 4 varies; a first suction port I1 that is a suction port opened to a suction region of the pump element 4 and which is provided to the pump housing 1; a first discharge port E1 that is a discharge port opened to a discharge region of the pump element 4 and which is provided to the pump housing 1; a suction passage 13 provided to the pump housing 1 and used for supplying the hydraulic fluid to the first suction port I1; a discharge passage 14 (second discharge passage 142) provided to the pump housing 1 and used for supplying the hydraulic fluid discharged from the first discharge port E1 to an outside of the pump housing 1; a variable metering orifice MO that is a throttle portion provided to the discharge passage 14; a first control valve 5 that is a first control valve 5 controlled based on a pressure on an upstream side and a pressure on a downstream side of the variable metering orifice MO, and which is configured to control a pressure to be introduced into the first fluid pressure chamber P1 with the pressure on the upstream side of the metering orifice MO and a pressure of the suction passage 13; and a second control valve 6 that is a second control valve 6 configured to variably control an opening area of the variable metering orifice MO, and which is provided with a second valve body 61 that is a valve body controlled based on the pressure of the suction passage 13 and a pressure of the first fluid pressure chamber P1.

In this way, in the present embodiment, the variable displacement pump is configured such that the opening area of the variable metering orifice MO is variably controlled by the second control valve 6 having the second spool valve body 61 that is different from the cam ring 2. That is, in the second control valve 6 configured as a spool valve according to the present embodiment, an amount of movement (stroke amount) of the second spool valve body 61 can be further largely ensured. Consequently, the opening area of the variable metering orifice MO can be controlled without being restricted by a range of variation in the proper discharge amount based on an amount of movement of the cam ring 2, thereby achieving sufficient energy conservation of the pump.

In addition, in the present embodiment, the pressure of the suction passage 13 is introduced into the second fluid pressure chamber P2.

In this way, when, by introducing a higher pressure than that in the second fluid pressure chamber P2 into the first fluid pressure chamber P1, the cam ring 2 is driven based on the differential pressure between the first fluid pressure chamber P1 and the second fluid pressure chamber P2, by introducing a suction pressure into the second fluid chamber P2, the introduction pressure of the first fluid pressure chamber P1 can be set to relatively low. As that result, the control pressure of the second control valve 6 can be set to low, thereby achieving improvement of controllability of the second control valve 6. In other words, for example, like the present embodiment, in the second control valve 6, in a case where a spring (second coil spring 63) resisting the pressure of the first fluid pressure chamber P1 is provided, if the pressure of the first fluid pressure chamber P1 is high, it becomes necessary to provide a stronger spring capable of resisting the pressure, and controllability of the second control valve 6 deteriorates.

In addition, in the present embodiment, the second control valve 6 is configured to increase the opening area of the variable metering orifice MO accompanying a rise in the downstream pressure of the variable metering orifice MO.

For example, like the present embodiment, in a case where the variable displacement pump is used as a liquid pressure source of the power steering device PS, the downstream pressure of the variable metering orifice MO may arise accompanying a steering operation. Therefore, by increasing the opening area of the variable metering orifice MO accompanying the rise in this downstream pressure, a discharge amount is reduced at the time of non-steering, and the discharge amount can be increased in accordance with the steering operation. Consequently, while achieving sufficient energy conservation by the pump driving, preferable steering assist control of the power steering device PS can be achieved.

In addition, in the present embodiment, the second spool valve body 61 is a spool valve body, and includes a first pressure receiving portion S1 on which the pressure of the first fluid pressure chamber P1 acts.

In this way, by configuring the second control valve 6 as a spool valve, a stroke amount can be relatively largely ensured with respect to the cam ring 2, and thereby a control range of the variable metering orifice MO can be largely ensured.

In addition, in the present embodiment, the second spool valve body 61 includes: a second pressure receiving portion S2 for biasing the second spool valve body 61 in a direction in which the opening area of the variable metering orifice MO increases by acting the downstream pressure of the variable metering orifice MO thereon; and a third pressure receiving portion S3 for biasing the second spool valve body 61 in a direction in which the opening area of the variable metering orifice MO decreases by acting the downstream pressure of the variable metering orifice MO thereon, the third pressure receiving portion S3 which has a smaller pressure receiving area than a pressure receiving area of the second pressure receiving portion S2.

According to the above configuration, the downstream pressure of the variable metering orifice MO acts on the second pressure receiving portion S2 and the third pressure receiving portion S3, and by the pressure receiving area difference therebetween, the second spool valve body 61 is biased in the direction in which the opening area of the variable metering orifice MO increases, and thereby the proper discharge amount can be increased.

In addition, in the present embodiment, the second control valve 6 includes a thrust imparting mechanism TM for imparting thrust to the second spool valve body 61 in a direction in which the opening area of the variable metering orifice MO increases, accompanying a rise in the downstream pressure of the variable metering orifice MO.

By also the above thrust imparting mechanism TM, the proper discharge amount can be increased accompanying the rise in the downstream pressure of the variable metering orifice MO.

In addition, in the present embodiment, the second control valve 6 is provided with the first pressure chamber 60*a* into which, through the first pressure introduction passage 171, the pressure of the first fluid pressure chamber P1 is introduced and the second pressure chamber 60*b* into which, through the second pressure introduction passage 172, the pressure of the second fluid pressure chamber P2 or the suction passage 13 is introduced, and the first pressure introduction passage 171 or the second pressure introduction passage 172 (both of them in the present embodiment) includes the damper orifice DO1 or the damper orifice DO2.

For example, like the present embodiment, by providing the damper orifice DO2 to the second pressure introduction passage 172, the vibration of the second spool valve body 61 can be suppressed. In particular, like the present embodiment, in the configuration in which the opening area of the variable metering orifice MO varies accompanying a variation in the downstream pressure of the metering orifice MO, the vibration of the second spool valve body 61 due to the fluctuation of the downstream pressure of the variable metering orifice MO can be suppressed.

In addition, in the present embodiment, the second control valve 6 includes the second spool valve accommodation hole 115 that is a spool valve accommodation hole extending in the moving direction of the second spool valve body 61, the discharge passage opening part 60*c* provided to the second spool accommodation hole 115 and opened to the second discharge passage 142, and the land parts (first land part 611, second land part 612, third land part 613) for changing the opening area of the discharge passage opening part 60*c*, accompanying the movement of the second spool valve body 61.

According to the configuration, by a simple structure, the variable metering orifice MO can be configured.

In addition, in the present embodiment, the discharge passage opening part 60*c* has a circular shape in cross section.

In this way, by forming the cross section of the discharge passage opening part 60*c* in a circular shape, a variation in flow rate in the variable metering orifice MO does not become a simple linear variation, but can be changed to a secondary or higher-order curved variation. In addition to this, this variation can be smoothly changed. Consequently, for example, a sudden change of a steering force in a case where the variable displacement pump is used as a liquid pressure source of the power steering device PS like the present embodiment can be suppressed.

Variation

Figure 8:
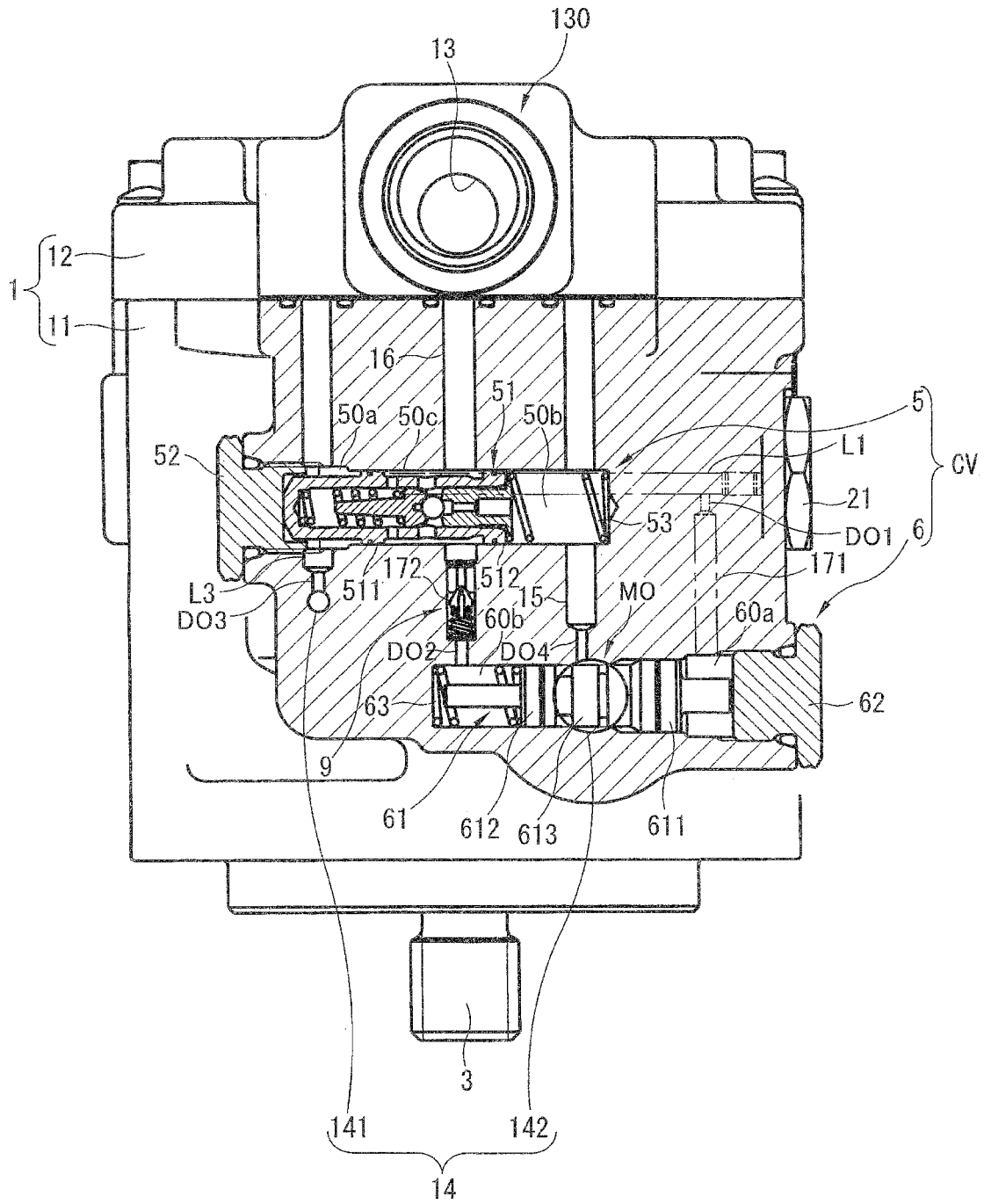
FIG. 8 is a drawing showing a variation of the first embodiment of the present invention that corresponds to FIG. 4.
Figure 9:
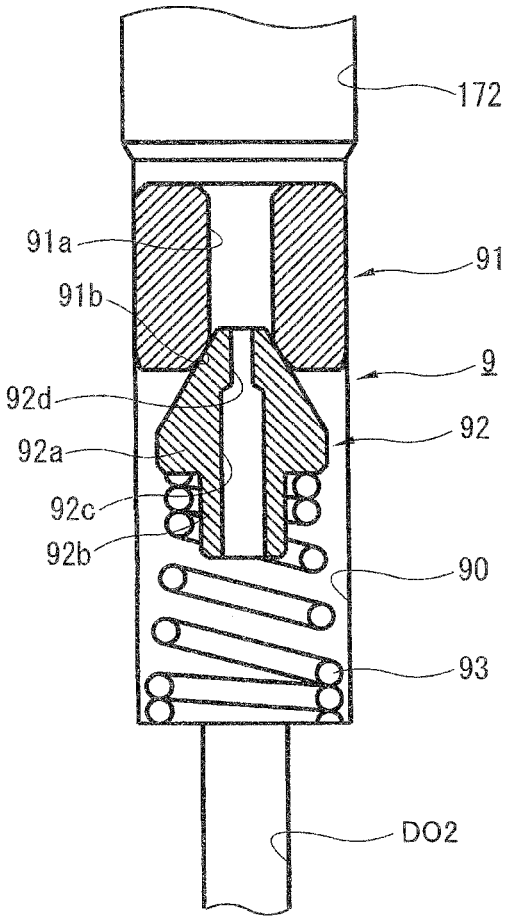
FIG. 9 is an enlarged view of a damper valve shown in FIG. 8.

FIG. 8 and FIG. 9 each show a variation of the first embodiment of the variable displacement pump according to the present invention, in which a damper valve 9 for buffering the vibration of the flow directed toward the second pressure chamber 60*b* is added to the second pressure introduction passage 172 according to the first embodiment.

As shown in FIG. 8 and FIG. 9, the damper valve 9 provided to the second pressure introduction passage 172 is a one-way valve, and is disposed in a damper valve accommodation chamber 90 that is a cylindrical space formed at a position immediately before the second damper orifice DO2 formed in a step shape at the downstream-side end portion of the second pressure introduction passage 172 such that the diameter thereof is reduced. That is, the damper valve 9 includes a cylindrical seat member 91 fitted into and fixed to the inner circumferential surface of the damper valve accommodation chamber 90, a valve body 92 which opens and closes the after-mentioned communication passage 91*a* by being seated on or separating from the opening edge portion on the downstream side of the inner circumferential passage (after-mentioned communication passage 91*a*) of the seat member 91, and a valve spring 93 for biasing the valve body 92 in the closing direction.

The seat member 91 is made of, for example, resin material and formed in a substantially cylindrical shape, and the communication passage 91*a* having a fixed diameter is penetratingly formed on the inner circumferential side of the seat member 91 along the central axis. A valve seat 91*b* which disconnects a communication by seating the valve body 92 thereon is formed on the downstream-side end portion of the communication passage 91*a*. The valve seat 91*b* is formed in a conical tapered shape of which the diameter is gradually enlarged toward the opening end.

The valve body 92 is made of, for example, resin material and is formed integrally with a valve portion 92*a* provided on one end side of the valve body 92 and used for the opening and the closing of the communication passage 91*a* by being seated on and separating from the valve seat 91*b*, and a base portion 92*b* provided on the other end side, formed in a step shape such that the diameter thereof is reduced with respect to the valve portion 92*a* and used for the link with the one end portion of the valve spring 93.

In addition, a constant communication passage 92*c* which is capable of always communicating the upstream side and the downstream side of the damper valve 9 is formed to penetrate the middle part of the valve body 92 along the central axis. That is, by this constant communication passage 92*c*, the flow of the hydraulic fluid from the second pressure chamber 60*b* side to the low pressure passage 16 side in accordance with the volume variation of the second pressure chamber 60*b* in the valve closing state is ensured.

Moreover, an orifice 92*d* whose diameter is reduced in a step shape toward the upstream side is formed at the end portion on the upstream side of the constant communication passage 92*c*. That is, by this orifice 92*d*, the vibration of the flow of the hydraulic fluid flowing from the low pressure passage 16 side to the second pressure chamber 60*b* side is buffered.

In the valve spring 93, one end side thereof has a truncated conical shape in side view whose diameter is gradually reduced, and the one end side is seated on the step portion formed between the valve portion 92*a* and the base portion 92*b*, and engages with the base portion 92*b* so as to surround the outer circumferential side of the base portion 92*b* of the valve body 92. On the other hand, the other end side thereof is seated on the bottom wall of the damper valve accommodation chamber 90. That is, the valve spring 93 always biases the valve body 92 in the closing direction by being inserted between the valve body 92 and the bottom wall of the damper valve accommodation chamber 90 with a predetermined set load.

As the above configuration, in the variable displacement pump according to the present variation, the second control valve 6 is provided with the first pressure chamber 60*a* into which the pressure of the first fluid pressure chamber P1 is introduced through the first pressure introduction passage 171, and with the second pressure chamber 60*b* into which the pressure of the second fluid pressure chamber P2 or the suction passage 13 is introduced through the second pressure introduction passage 172, and includes the damper valve 9 for buffering the vibration of the flow directed toward the first pressure chamber 60*a* or the second pressure chamber 60*b*, at the first pressure introduction passage 171 or the second pressure introduction passage 172 (in the present variation, the second pressure introduction passage 172 only).

In this way, by providing the damper valve 9 that is a one-way valve to the first pressure introduction passage 171 or the second pressure introduction passage 172 connected to the second control valve 6, the vibration of the second spool valve body 61 can be suppressed. In particular, like the present variation, in the configuration in which the opening area of the variable metering orifice MO varies in accompanying a variation in the downstream pressure of the variable metering orifice MO, the vibration of the second spool valve body 61 due to the variation of the downstream pressure of the metering orifice MO can be suppressed.

In addition, in the present variation, the damper valve 9 is provided to the second pressure introduction passage 172.

In this way, by not providing the damper valve 9 to the first pressure introduction passage 171, failure that the responsiveness of the control for the increase of the discharge amount, accompanying the increase in the pressure on the power steering device PS side (increase in the downstream pressure of the variable metering orifice MO), can be suppressed. On the other hand, by providing the damper valve 9 to the second pressure introduction passage 172, the vibration of the second spool valve body 61 can be suppressed.

Here, although, as an example, in the present variation, a mode in which the damper valve 9 is disposed on only the second pressure introduction passage 172 has been explained, needless to say, the damper valve 9 can be also disposed on the first pressure introduction passage 171.

Second Embodiment

Figure 10:
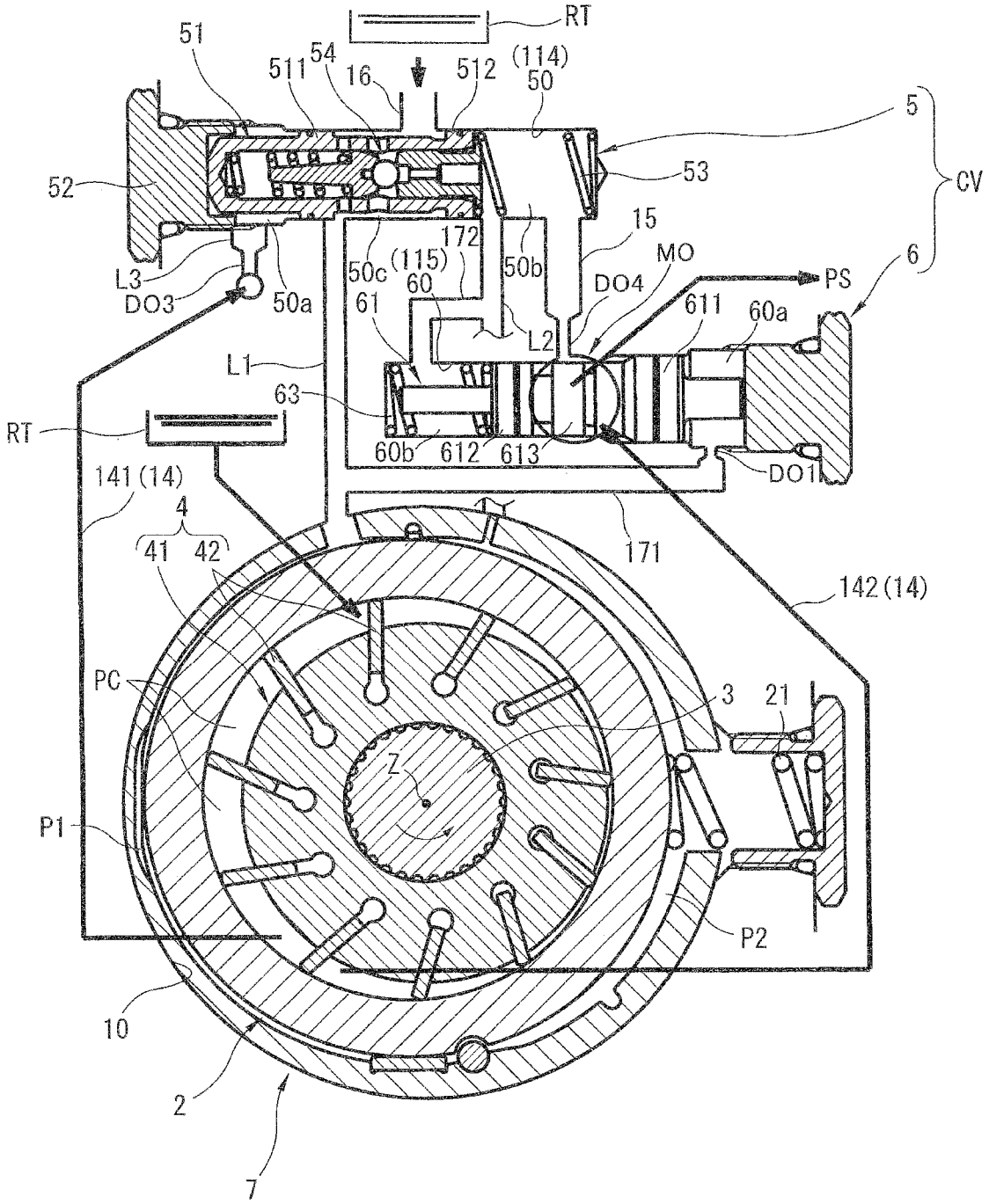
FIG. 10 is a schematic diagram showing a configuration of a variable displacement pump according to a second embodiment of the present invention.

FIG. 10 is one showing a second embodiment of the variable displacement pump according to the present invention, and the pressure to be introduced into the second fluid pressure chamber P2 of the variable displacement pump according to the first embodiment is changed. Since the basic structure of the second embodiment except changed parts is the same as that of the first embodiment, the same symbols are applied to the same components as those of the first embodiment, and the redundant explanation is omitted.

As shown in FIG. 10, the variable displacement pump according to the present embodiment is configured such that the intermediate pressure chamber 50*b* of the first control valve 5 is able to communicate with the second fluid pressure chamber P2 through a second communication passage L2. With this, the pressure on the downstream side of the variable metering orifice MO is introduced into the second fluid pressure chamber P2 through the second communication passage L2. According to the configuration, by the pressure inside the reservoir tank RT or the pressure on the upstream side of the variable metering orifice MO to be introduced into the first fluid pressure chamber P1 by being switched and the pressure on the downstream side of the variable metering orifice MO to be introduced into the second fluid pressure chamber P2, the oscillation control of the cam ring 2 is carried out.

Moreover, in the present embodiment, it is configured such that the intermediate pressure chamber 50*b* of the first control valve 5 is able to communicate with the second pressure chamber 60*b* through the second pressure introduction passage 172 formed by branching from the second communication passage L2. With this, the pressure on the downstream side of the variable metering orifice MO is introduced into the second pressure chamber 60*b* through the second pressure introduction passage 172. According to the configuration, by the pressure inside the reservoir tank RT or the pressure on the upstream side of the variable metering orifice MO to be introduced into the first pressure chamber 60*a* by being switched and the pressure on the downstream side of the variable metering orifice MO to be introduced into the second pressure chamber 60*b*, the second spool valve 61 is movably controlled.

As the above, in the variable displacement pump according to the present embodiment, the pressure on the downstream side of the variable metering orifice MO is introduced into the second fluid pressure chamber P2.

In this way, by introducing the downstream pressure of the variable metering orifice MO into the second fluid pressure chamber P2, the stability of the cam ring 2 at the time when the pressure (suction pressure) inside the reservoir tank RT is introduced into the first fluid pressure P1 can be improved. That is, by acting a high pressure on the both sides of the cam ring 2, even in a case where, for example, the cam ring 2 is biased in the concentric direction by the pressure inside the pump chambers PC in the discharge region, the oscillation control of the cam ring 2 can be stably carried out.

In addition, since, by the differential pressure between the first fluid pressure chamber P1 and the second fluid pressure chamber P2, the second spool valve 61 of the second control valve 6 is movably controlled, the differential pressure becomes relatively small, and consequently, the set load of the second coil spring 63 can be reduced. That is, it is possible to movably control the second spool valve body 61 with a smaller biasing force, and thereby the controllability of the second control valve 6 can be improved.

The present invention is not limited to the configurations and the modes exemplified in the embodiments, and if it is a mode which is capable of obtaining the above-mentioned working effects of the present invention, it can be freely modified in accordance with specifications and cost of an object to be applied.

In particular, in the above embodiment, although a mode in which the second control valve 6 is included in the pump housing 1 has been explained as an example, the second control valve 6 can be provided separately from the pump housing 1. In this case, the size of the pump housing 1 in a single state can be reduced, and thereby layout properties of the pump can be improved.

As a variable displacement pump based on the embodiments explained above, for example, following aspects can be considered.

That is, the variable displacement pump concludes: a pump housing including a pump element accommodation part thereinside; a cam ring formed in an annular shape and provided inside the pump element accommodation part; a pump element rotatably provided inside the cam ring and configured to carry out suction and discharge of hydraulic fluid; a first fluid pressure chamber and a second fluid pressure chamber that are a pair of spaces provided between the pump element accommodation part and the cam ring, wherein by acting a pressure of at least the first fluid pressure chamber on the cam ring, the cam ring is driven, and a proper discharge amount that is a discharge amount per one rotation of the pump element varies; a suction port provided to the pump housing and opened to a suction region of the pump element; a discharge port provided to the pump housing and opened to a discharge region of the pump element; a suction passage provided to the pump housing and used for supplying the hydraulic fluid to the suction port; a discharge passage provided to the pump housing and used for supplying the hydraulic fluid discharged from the discharge port to an outside of the pump housing; a variable metering orifice that is a throttle portion provided to the discharge passage; a first control valve that is a first control valve controlled based on a pressure on an upstream side and a pressure on a downstream side of the variable metering orifice, and which is configured to control a pressure to be introduced into the first fluid pressure chamber with the pressure on the upstream side of the metering orifice and a pressure of the suction passage; and a second control valve that is a second control valve configured to variably control an opening area of the variable metering orifice, and which is provided with a valve body controlled based on a pressure of the second fluid pressure chamber or the suction passage and a pressure of the first fluid pressure chamber.

In a preferable aspect of the variable displacement pump, the pressure of the suction passage is introduced into the second fluid pressure chamber.

In a preferable aspect of the variable displacement pump, the pressure on the downstream side of the variable metering orifice is introduced into the second fluid pressure chamber.

In another preferable aspect, in any of aspects of the variable displacement pump, the second control valve is configured to increase the opening area of the variable metering orifice with a rise in the downstream pressure of the variable metering orifice.

In yet another preferable aspect, in any of aspects of the variable displacement pump, the valve body is a spool valve body, and includes a first pressure receiving portion on which the pressure of the first fluid pressure chamber acts.

In yet another preferable aspect, in any aspects of the variable displacement pump, the spool valve body includes: a second pressure receiving portion for biasing the spool valve body in a direction in which the opening area of the variable metering orifice increases by acting the downstream pressure of the variable metering orifice thereon; and a third pressure receiving portion for biasing the spool valve body in a direction in which the opening area of the variable metering orifice decreases by acting the downstream pressure of the variable metering orifice thereon, the third pressure receiving portion having a smaller pressure receiving area than a pressure receiving area of the second pressure receiving portion.

In yet another preferable aspect, in any aspects of the variable displacement pump, the second control valve includes a thrust imparting mechanism for imparting thrust to the spool valve body in a direction in which the opening area of the variable metering orifice increases with a rise in the downstream pressure of the variable metering orifice.

In yet another preferable aspect, in any aspects of the variable displacement pump, the second control valve includes: a first pressure chamber into which, through a first pressure introduction passage, the pressure of the first fluid pressure chamber is introduced; and a second pressure chamber into which, through a second pressure introduction passage, the pressure of the second fluid pressure chamber or the suction passage is introduced, and a damper orifice that is a throttle portion is provided to the first pressure introduction passage or the second pressure introduction passage.

In yet another preferable aspect, in any aspects of the variable displacement pump, the second control valve includes: a first pressure chamber into which, through a first pressure introduction passage, the pressure of the first fluid pressure chamber is introduced; and a second pressure chamber into which, through a second pressure introduction passage, the pressure of the second fluid pressure chamber or the suction passage is introduced, and a damper valve for buffering vibration of flow directed toward the first pressure chamber or the second pressure chamber is provided to the first pressure introduction passage or the second pressure introduction passage.

In yet another preferable aspect, in any aspects of the variable displacement pump, the damper valve is provided to the second pressure introduction passage.

In yet another preferable aspect, in any aspects of the variable displacement pump, the second control valve includes: a spool valve accommodation hole extending in a moving direction of the spool valve body; a discharge passage opening part provided to the spool valve accommodation hole and opened to the discharge passage; and a land part provided to the spool valve body and formed for varying the opening area of the discharge passage opening part with movement of the spool valve.

In yet another preferable aspect, in any aspects of the variable displacement pump, the discharge passage opening part has a circular shape in cross section.

In yet another preferable aspect, in any aspects of the variable displacement pump, the second control valve is provided separately from the pump housing.

The invention claimed is:

1. A variable displacement pump, comprising:

a pump housing including a pump element accommodation part thereinside;

a cam ring formed in an annular shape and provided inside the pump element accommodation part;

a rotor and a plurality of vanes configured to carry out suction and discharge of hydraulic fluid, wherein the rotor is rotatably provided inside the cam ring, and wherein the plurality of vanes are accommodated on an outer circumferential side of the rotor so as to retractably move through the outer circumferential side in a radial direction, and wherein a plurality of pump chambers, each of which is partitioned by a pair of vanes of the plurality of vanes arranged adjacent to each other, are formed between the cam ring and the rotor;

a first fluid pressure chamber and a second fluid pressure chamber that are a pair of spaces provided between the pump element accommodation part and the cam ring, wherein a pressure within the first fluid pressure chamber moves the cam ring about a pin member in the pump element accommodation part to vary a discharge amount from a pump formed of the rotor and the vanes;

a suction port provided to the pump housing and opened to a suction region formed between the cam ring and the rotor;

a discharge port provided to the pump housing and opened to a discharge region formed between the cam ring and the rotor;

a suction passage provided to the pump housing and used for supplying the hydraulic fluid to the suction port;

a discharge passage provided to the pump housing and used for supplying the hydraulic fluid discharged from the discharge port to an outside of the pump housing;

a variable metering orifice that is a throttle portion provided to the discharge passage;

a first control valve controlled based on a pressure within the discharge region of the pump chambers and a pressure of a downstream side of the variable metering orifice, and which is configured to control a pressure to be introduced into the first fluid pressure chamber with a pressure on the variable metering orifice and a pressure of the suction passage; and a second control valve configured to variably control an opening area of the variable metering orifice, and provided with a valve body controlled based on a pressure of the second fluid pressure chamber or the pressure of the suction passage and a pressure of the first fluid pressure chamber.

2. The variable displacement pump according to claim 1, wherein the pressure of the suction passage is introduced into the second fluid pressure chamber.

3. The variable displacement pump according to claim 1, wherein the pressure on the downstream side of the variable metering orifice is introduced into the second fluid pressure chamber.

4. The variable displacement pump according to claim 1, wherein the second control valve is configured to increase the opening area of the variable metering orifice with a rise in the downstream pressure of the variable metering orifice.

5. The variable displacement pump according to claim 4, wherein the valve body is a spool valve body, and includes a first pressure receiving portion on which the pressure of the first fluid pressure chamber acts.

6. The variable displacement pump according to claim 5, wherein the spool valve body includes:

a second pressure receiving portion for biasing the spool valve body in a direction in which the opening area of the variable metering orifice increases by acting the downstream pressure of the variable metering orifice thereon; and a third pressure receiving portion for biasing the spool valve body in a direction in which the opening area of the variable metering orifice decreases by acting the downstream pressure of the variable metering orifice thereon, the third pressure receiving portion having a smaller pressure receiving area than a pressure receiving area of the second pressure receiving portion.

7. The variable displacement pump according to claim 5, wherein the second control valve includes a first land part and a second pressure receiving portion for imparting thrust to the spool valve body in a direction in which the opening area of the variable metering orifice increases with the rise in the downstream pressure of the variable metering orifice.

8. The variable displacement pump according to claim 1, wherein the valve body is a spool valve body, and includes a first pressure receiving portion on which the pressure of the first fluid pressure chamber acts.

9. The variable displacement pump according to claim 8, wherein the second control valve includes:

a first pressure chamber into which, through a first pressure introduction passage, the pressure of the first fluid pressure chamber is introduced; and a second pressure chamber into which, through a second pressure introduction passage, the pressure of the second fluid pressure chamber or the suction passage is introduced, and wherein a damper orifice that is a throttle portion is provided to the first pressure introduction passage or the second pressure introduction passage.

10. The variable displacement pump according to claim 8, wherein the second control valve includes:

a first pressure chamber into which, through a first pressure introduction passage, the pressure of the first fluid pressure chamber is introduced; and a second pressure chamber into which, through a second pressure introduction passage, the pressure of the second fluid pressure chamber or the suction passage is introduced, and wherein a damper valve for buffering vibration of flow directed toward the first pressure chamber or the second pressure chamber is provided to the first pressure introduction passage or the second pressure introduction passage.

11. The variable displacement pump according to claim 10, wherein the damper valve is provided to the second pressure introduction passage.

12. The variable displacement pump according to claim 8, wherein the second control valve includes:

a spool valve accommodation hole extending in a moving direction of the spool valve body;

a discharge passage opening part provided to the spool valve accommodation hole and opened to the discharge passage; and a land part provided to the spool valve body and formed for varying the opening area of the discharge passage opening part with movement of the spool valve.

13. The variable displacement pump according to claim 12, wherein the discharge passage opening part has a circular shape in cross section.

14. The variable displacement pump according to claim 1, wherein the second control valve is provided separately from the pump housing.

* * * * *